US005360533A

United States Patent [19]

Tagamolila et al.

[11] Patent Number: 5,360,533

[45] Date of Patent: Nov. 1, 1994

[54] DIRECT DRY GAS RECOVERY FROM FCC REACTOR

[75] Inventors: Constante P. Tagamolila, Arlington Heights; Edward C. Haun, Glendale Heights; David A. Lomas, Barrington; Joseph E. Zimmermann, Arlington Heights, all of Ill.

[73] Assignee: UOP, Des Plaines, Ill.

[21] Appl. No.: 73,396

[22] Filed: Jun. 8, 1993

[51] Int. Cl.[5] ..... C10G 51/00; C10G 53/08; C10G 55/06

[52] U.S. Cl. ..... 208/101; 208/74; 208/83; 208/103; 208/105; 208/108

[58] Field of Search ..... 208/48 Q, 78, 100, 101, 208/103, 104, 105, 113, 74, 50, 59, 96, 99, 146, 147, 155, 157, 83, 108; 422/190; 585/519

[56] References Cited

U.S. PATENT DOCUMENTS

| | | | |
|---|---|---|---|
| 3,928,173 | 12/1975 | James | 208/78 |
| 4,831,203 | 5/1989 | Oxxen et al. | 585/519 |
| 4,988,430 | 1/1991 | Sechrist et al. | 208/113 |
| 5,104,517 | 4/1992 | Lomas et al. | 208/113 |
| 5,176,815 | 1/1993 | Lomas | 208/78 |

*Primary Examiner*—Asok Pal
*Assistant Examiner*—Bekir L. Yildirim
*Attorney, Agent, or Firm*—Thomas K. McBride; John G. Tolomei

[57] ABSTRACT

A FCC product recovery section operates at greater efficiency by recovering separate riser product streams and reactor product streams and quenching and absorbing lighter, more valuable hydrocarbon products from the reactor product stream in separate quench and absorption vessels. The quench and absorbtion vessels are intergrated with a main fractionator and gas concentration section of a typical FCC product recovery section. Heavy hydrocarbons, clarified oil and/or cycle oil absorb hydrocarbons from the reactor product stream in the quench and absorption vessels and return the absorbed products to the main fractionator while net gasoline product from the reactor product stream enter the primary absorber of the gas concentration section. This arrangement is particularly useful in increasing the product recovery capacity of an existing FCC product separation section.

21 Claims, 1 Drawing Sheet

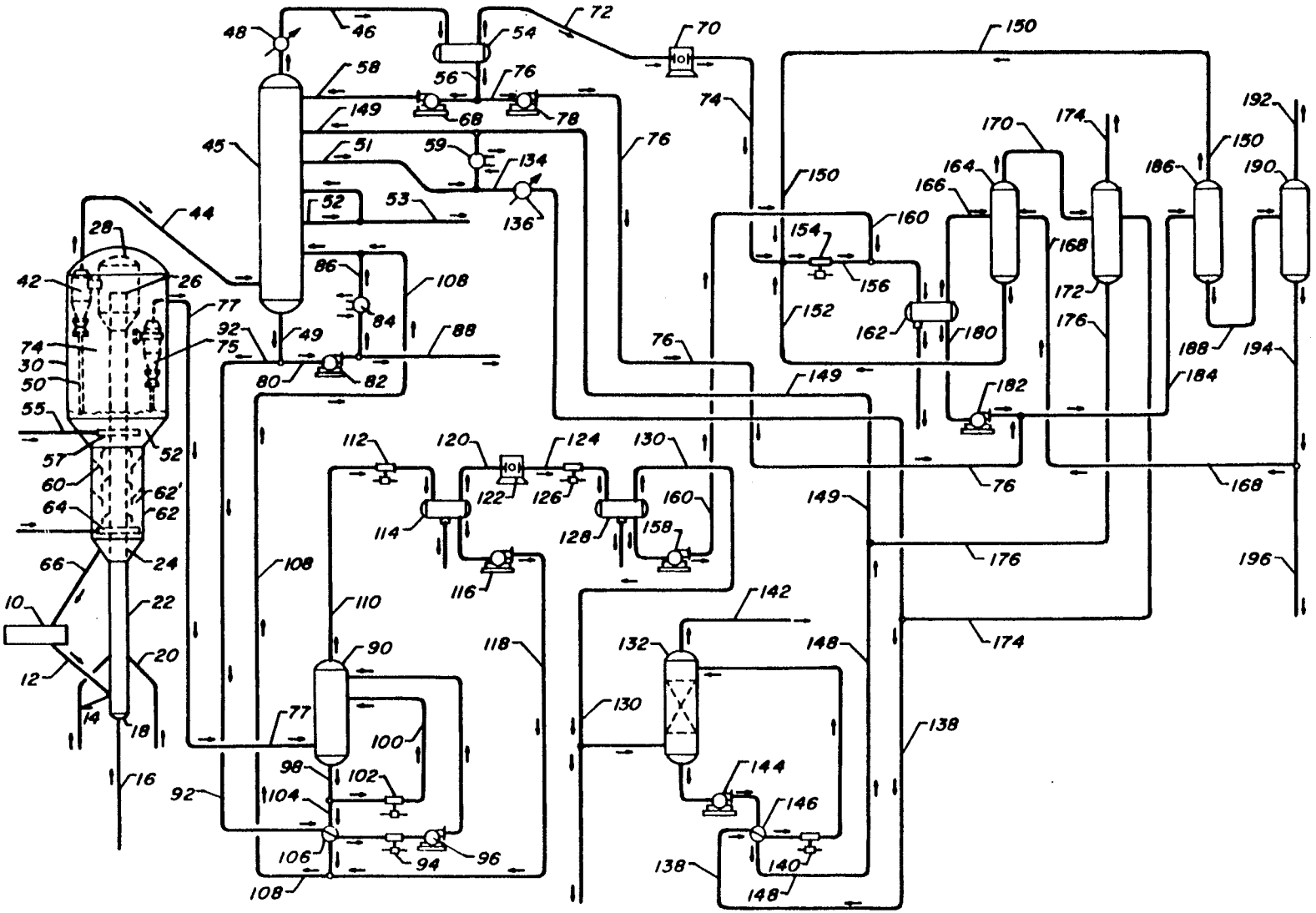

DIRECT DRY GAS RECOVERY FROM FCC REACTOR

FIELD OF THE INVENTION

This invention relates generally to processes for the fluidized catalytic cracking (FCC) of heavy hydrocarbon streams such as vacuum gas oil and reduced crudes. This invention relates more specifically to a method for reacting hydrocarbons in an FCC reactor and separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium. The FCC process is carried out by contacting the starting material, whether it be vacuum gas oil, reduced crude, or another source of relatively high boiling hydrocarbons, with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. The cracking reaction deposits coke on the catalyst. Coke is comprised of hydrogen and carbon and can include other materials in trace quantities such as sulfur and metals that enter the process with the starling material. Coke interferes with the catalytic activity of the catalyst by blocking active sites on the catalyst surface where the cracking reactions take place. Spent catalyst, i.e., partially deactivated by the deposition of coke upon the catalyst, exits the reactions zone. Traditionally, catalyst passes from the stripper to a regenerator that removes the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. Some of the heat may also be recovered by heat exchange of a circulating catalyst stream against a cooling fluid such as boiler feed water to generate steam. The balance of the heat leaves the regenerator with the regenerated catalyst. The fluidized catalyst circulates continuously from the reaction zone to the regeneration zone and then again to the reaction zone. The fluidized catalyst, as well as providing a catalytic function, acts as a vehicle for the transfer of heat from zone to zone. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction temperatures change. That is, increase in the flow rate of circulating fluid catalyst from the regenerator to the reactor effects an increase in the conversion rate. Since the catalyst temperature in the regeneration zone is usually held at a relatively constant temperature, significantly higher than the reaction zone temperature, any increase in catalyst flux from the relatively hot regeneration zone to the reaction zone raises the reaction zone temperature.

One improvement to FCC units, that has reduced the product loss by thermal cracking, is the use of riser cracking. In riser cracking, regenerated catalyst and starting materials enter a pipe reactor. The expansion of the gases formed by contact with hot catalyst upon the hydrocarbons and other fluidizing mediums, if present, transports the mixture upward. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas accelerates catalyst in a first section of the riser before introduction of the feed and thereby reduces the turbulence which can vary the contact time between the catalyst and hydrocarbons.

In most reactor arrangements, catalysts and conversion products still enter a large chamber that initially disengages catalyst and hydrocarbons. Cyclone separators use centripetal acceleration to disengage the heavier catalyst particles from the lighter vapors and to perform a final separation of hydrocarbon vapors which exit the reaction zone.

Product recovery facilities recover the hydrocarbon product of the FCC reaction in vapor form. These facilities normally comprise a primary fractionation zone, more commonly referred to as the main column for cooling the hydrocarbon vapor from the reactor and recovering a series of heavy cracked products which usually include bottoms material, cycle oil, and heavy gasoline. Lighter materials from the main column enter a concentration section for further separation into additional product streams.

The advances in FCC technology have enabled FCC unit owners to increase the feed process in a given size unit. These advances include changes to the internals of the FCC unit as well as new catalyst developments and the use of other additives to increase the feed processing capacity of an FCC unit. The ability to increase the feed to the FCC unit can be limited by the size of the product separation facilities associated with the FCC unit which create a bottle-neck for further increases in the processing capacity. In particular, it has been found that the gas concentration section and more particularly the wet gas compressor, which is a main source of energy for the gas concentration section, will limit the total throughput of the FCC unit. The use of lift gas in an FCC unit can compound the difficulties in increasing throughput due to additional recycling of gas through the gas concentration section back to the reaction section.

While the benefits of using lift gas to pre-accelerate and condition regenerated catalyst in a riser type conversion zone are well known, lift gas typically has a low concentration of heavy hydrocarbons, i.e. "wet" gas comprising propane and higher boiling hydrocarbons, are usually avoided. Thus the recycling of lift gas streams, comprising a large quantity of dry gas (i.e., hydrocarbons having a lower boiling point than propane) impose extra burdens on the wet gas compressor of the gas concentration section by taking up capacity in the compressor which could be used for wet or heavy hydrocarbons.

DISCLOSURE STATEMENT

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 4,234,411, issued to Thompson on Nov. 18, 1980, discloses a reactor riser disengagement vessel and stripper that receives two independent streams of catalyst from a regeneration zone.

U.S. Pat. No. 4,479,870, issued to Hammershaimb et al. on Jun. 30, 1984, teaches the use of lift gas having a specific composition in a riser zone at a specific set of flowing conditions with the subsequent introduction of the hydrocarbon feed into the flowing catalyst and lift gas stream.

U.S. Pat. No. 4,988,430 to Sechrist et. al. discloses a system for recovering lift gas as a separate stream from an FCC reaction zone.

BRIEF DESCRIPTION OF THE INVENTION

It is an object of this invention to increase the product processing capacity of an FCC product separation section.

It is a further object of this invention to decrease the dry gas loading on a wet gas compressor in an FCC gas concentration section.

Yet a further object of this invention is to provide a source of lift gas that eliminates the recycling of dry gas through the wet gas compressor of an FCC gas concentration section.

Accordingly, this invention is an FCC process that reacts an FCC feedstock in a reactor riser and directly separates a majority of reactor riser products from the catalyst to provide a riser product stream and separates a lesser portion of hydrocarbons and gases originating in the riser from catalyst in the reactor vessel to recover a reactor product stream which enters a reactor quench zone. The reactor quench zone isolates dry gas from the primary fractionation zone (main column) of the FCC separation facilities. Essentially none of the dry gas taken by the reactor product stream passes through the wet gas compressor of the FCC gas concentration section. A quench stream originating from the primary fractionation zone returns absorbed C3 and higher hydrocarbons from the reactor quench zone back to the primary fractionation zone. Principally dry gas leaving the quench vessel undergoes absorption either in a reactor absorber vessel or in a secondary or sponge absorber of the gas concentration section to absorb additional C3 and higher hydrocarbons that a light cycle oil absorbent stream carries back to the primary fractionation zone.

It has been found that recovering a reactor product stream from the reactor vessel volume will provide a product stream containing a high concentration of dry gas components. Separately processing the dry gas components in a quench vessel allows absorption of the C3 and higher hydrocarbons to be carried out without passing these dry gas components through the wet gas compressor. Unloading the wet gas compressor in this manner increases the total capacity of the FCC gas concentration section. Therefore, the reactor and regenerator section of an FCC unit may be revamped to accommodate higher product flows without requiring an accompanying replacement of equipment in the product separation and gas recovery sections. This arrangement may also be used in the design of new units to reduce the overall equipment size and energy cost associated with the separation and recovery of FCC products.

Accordingly, in one embodiment, this invention is a process for the fluidized catalytic cracking of hydrocarbons. The process comprises contacting an FCC feedstock and regenerated catalyst particles in a reactor riser and transporting the catalyst and feedstock through the riser to convert the feedstock. The process discharges a mixture of catalyst particles and gaseous hydrocarbons from a discharge end of the riser directly into a separation zone, separates gaseous hydrocarbons from catalyst containing adsorbed hydrocarbons and recovers a riser effluent stream from the separation zone. Catalyst containing adsorbed hydrocarbons from the separation zone passes into a reaction vessel that maintains a dense bed of catalyst in the reaction vessel and from which a reactor effluent stream is withdrawn from the reactor vessel. The process separates the riser effluent stream in a primary fractionation zone into fractions comprising a heavy bottoms liquid stream, a light cycle oil stream and a gasoline stream and a light hydrocarbon vapor stream, consisting of primarily $C_3$ and $C_5$. The reactor effluent stream passes to a reactor quench zone that contacts the reactor effluent stream with at least a portion of at least one of said fractions in the quench zone to absorb propane and heavier hydrocarbons from the reactor effluent stream and produce a quenched overhead stream and a primary recycle stream. The primary recycle stream is returned to the primary fractionation zone. The process passes at least a fraction of the quenched overhead stream to a reactor absorber and contacts the fraction of the quenched overhead stream with at least a portion of the light cycle oil stream in the reactor absorber to absorb propane and heavier hydrocarbons from the quenched overhead stream and produce a reactor gas stream comprising ethane hydrocarbons and lower boiling gases and a propane-rich light cycle oil stream. The propane-rich light cycle oil stream is returned to the primary fractionation zone.

In a more complete embodiment, this invention is a process for the fluidized catalytic cracking of hydrocarbons in a riser type conversion zone. The process comprises: passing the FCC feedstock and regenerated catalyst particles to a reactor riser and transporting the catalyst and feedstock upwardly through the riser thereby converting the feedstock to a riser gaseous product stream; discharging a mixture of catalyst particles and gaseous products from a discharge end of the riser directly into a disengaging vessel, separating gaseous components from catalyst containing adsorbed hydrocarbons in the disengaging vessel and recovering a riser product stream from the disengaging vessel; passing the catalyst containing adsorbed hydrocarbons from the disengaging vessel into a reaction vessel, maintaining a dense bed of catalyst in the reaction vessel and withdrawing a reactor product stream from the reactor vessel; passing spent catalyst from the reactor vessel into a regeneration zone and contacting the spent catalyst with a regeneration gas in the regeneration zone to combust coke from the catalyst particles and produce regenerated catalyst particles for transfer to the reactor riser; separating the riser product stream in a primary fractionation zone and producing a heavy bottoms liquid stream, a light cycle oil stream and a gasoline stream; condensing the gasoline stream and separating the gasoline stream into a first vapor gasoline fraction and a first liquid gasoline fraction; passing the reactor product stream to a reactor quench zone and contacting the reactor product stream with a portion of the heavy bottoms liquid stream in the quench zone to absorb propane and higher boiling hydrocarbons from the reactor product stream and produce a quenched overhead stream and a heavy bottoms recycle stream and returning the heavy bottoms recycle stream to the primary fractionation zone; separating the quenched overhead fraction into a first absorber gas and a first recycle liquid and passing at least a portion of the first recycle liquid to the primary fractionation zone; separating the first absorber gas into a second absorber gas and a second recycle liquid; passing the second absorber gas to a reactor absorber and contacting the second absorber gas with a portion of the light cycle oil stream in the reactor absorber to absorb propane and higher boiling hydrocarbons from the second absorber gas and producing a reactor gas stream comprising $C_2$ hydrocarbons and lower boiling gases and a $C_3$ rich light oil stream and returning said $C_3$ rich light cycle oil stream to said primary fractionation zone; combining the second recycle liquid with the first vapor gasoline fraction and separating the combined stream into a second vapor gasoline fraction and second gasoline liquid fraction; stripping and debutanizing the second gasoline liquid fraction to produce a gasoline product stream; and, contacting the second gasoline vapor stream with a portion of at least one of the first liquid gasoline fraction and the gasoline product stream to absorb $C_2$ and lower boiling hydrocarbons and produce a light gas stream and a gasoline recycle stream and recycling the gasoline recycle stream to the first gasoline vapor stream.

This invention has the advantage of significantly decreasing the load on the wet gas compressor. It has been found that, the separate recovery of the reactor products stream reduces, the wet gas compressor loading by as much as 25% or more. Isolating and processing the lean reactor gas separately improves the efficiency of the primary absorber column in the gas concentration section by reducing the recycle of lean oil relative to the recovery of $C_3+$ components. This arrangement permits the throughput for a typical FCC unit to be raised by as much as 30% of existing capacity without replacing or revamping the wet gas compressor or other equipment associated with the dry gas portion of the gas concentration unit of an existing FCC complex.

In other aspects of this invention, the dry gas recovery section may also be incorporated more fully with a traditional gas concentration section of an FCC unit. In such an arrangement the net gas from the reactor quench zone, after different stages of compression and separation, passes to a sponge absorber present in a typical gas concentration section. The sponge absorber receives both the net gas from the primary absorber of the gas concentration section as well as the net gas from the reactor quench zone.

One advantage of the dry gas separation section of this invention is that it operates at relatively low pressure. The reactor quench zone will preferably operate at regenerator pressures of between 30 and 100 psig. A typical sponge absorber in an FCC process zone operates at a pressure in a range of from about 150 to 250 psig. Sending overhead gas directly to the secondary absorber of the gas concentration section would require additional compression and perhaps a multiple stage compressor.

In addition to recovering dry gas derived from the desorption and displacement of hydrocarbons from the catalyst exiting the riser separation zone, a variety of secondary feeds may also be charged to the reactor section. The secondary feeds will usually enter the dense bed portion of the reactor vessel and undergo long residence time cracking conditions before removal with the dry gas in the reactor product stream. A number of reactions can take place in the dense bed of the reactor vessel, including alkylation and transalkylation reactions. The use of the dense bed in the reactor vessel is more fully explained in U.S. Pat. No. 5,176,815, the contents of which are hereby incorporated by reference.

The independent separation of the reactor vessel product stream also offers the unexpected advantage of a source of hydrogen. While in most cases the presence of metals degrades the FCC operation by the aforementioned catalyst deactivation and overcracking of products, the process of this invention may derive a benefit from a controlled concentration of nickel on the catalyst. Nickel, present in moderate amounts, will promote cracking of alkyl groups from the heavy cyclic hydrocarbons that are adsorbed on the catalyst. This light hydrocarbon stream contains a relatively high concentration of hydrogen. By recovering a separate product stream from the reactor vessel, a light gas stream containing a high concentration of hydrogen is easily separated from the reactor vessel product stream.

Other objects, embodiments and details of this invention can be found in the following detailed description of the invention.

BRIEF DESCRIPTION OF THE DRAWINGS

The FIGURE is a schematic flow diagram for treating a riser product stream, an FCC riser and a dry gas stream obtained from a reactor vessel of an FCC unit.

DETAILED DESCRIPTION OF THE PREFERRED EMBODIMENT

The process and apparatus of this invention will be described with references to the drawings. Reference to the specific configurations shown in the drawings is not meant to limit the process of this invention to the particular details of the drawing disclosed in conjunction therewith. The basic process operation can be best understood with reference to FIG. 1.

Regenerated catalyst from a catalyst regenerator 10 is transferred by a conduit 12, to a Y-section 14. This invention can employ a wide range of commonly used FCC catalysts. These catalyst compositions include high activity crystalline alumina silicate or zeolite containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, aluminum, or zirconium. These catalyst compositions may have a zeolite content of 30% or more. Particularly preferred zeolites include high silica to alumina compositions such as LZ-210 and ZSM-5 type materials. Another particularly useful type of FCC catalysts comprises silicon substituted aluminas. As disclosed in U.S. Pat. No. 5,080,778, the zeolite or silicon enhanced alumina catalysts compositions may include intercalated clays, also generally known as pillared clays.

The catalyst first contacts lift gas injected into the bottom of Y-section 14, by a conduit 16, which carries the catalyst upward through a lower riser section 18. Although the figure shows this invention being used with a riser arrangement having a lift gas zone 18, a lift gas zone is not a necessity to enjoy the benefits of this invention.

Feed is injected into the riser above lower riser section 18 at feed injection points 20. Feeds suitable for processing by this invention, include conventional FCC feedstocks or higher boiling hydrocarbon feeds. The most common of the conventional feedstocks is a vacuum gas oil which is typically a hydrocarbon material having a boiling range of from 650°-1025° F. and is prepared by vacuum fractionation of atmospheric residue. Such fractions are generally low in coke precursors and heavy metals which can deactivate the catalyst. The invention is also useful for processing heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the riser.

The length of the riser will usually be set to provide a residence time of between 0.5 to 10 seconds at average flow velocity conditions. Other reaction conditions in the riser usually include a temperature of from 875°-1050° F. Typically, the catalyst circulation rate through the riser and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture.

Gas oil or residual feed contacting in the riser takes place under the typical short contact time conditions. Maintaining short contact times requires a quick separation of catalyst and hydrocarbons at the end of the riser. It is important to this invention that the separation device at the end of the riser provide a quick separation of the catalyst from the riser vapors and also limit the transfer of vapors from the riser into the dilute phase zone of the reactor vessel. The invention operates most effectively when the riser and reactor arrangement provides an essentially complete separation between the riser product and the reactor product streams. For the purposes of this invention, essentially complete separation is obtained when over 90% of the hydrocarbons from the riser are recovered in the riser product stream and when less than 10% of the riser products are carried with the catalyst into the reactor vessel. In the same manner, the amount of reactor products carried over from the reactor vessel into the riser product stream is also preferably minimized and kept below an amount of 10 wt %. Suitable separation devices for the end of the riser will provide a low catalyst residence time and recover at least 90 wt. % of the vapors discharged from the riser. Preferably, the separation device at the end of the riser will recover 95 wt. % of the vapors that the riser discharges. In addition, the separation device will also preferably provide a seal that allows no more than 10 wt. % and preferably no more than 5 wt. % of the vapors from dilute phase 74 to enter the disengaging device. In this manner, at least 90 wt. % of the products from the reactor vessel reaction zone are recovered without intermixing with riser product stream.

The mixture of feed, catalyst and lift gas travels up an intermediate section 22 of the riser and into an upper internal riser section 24 that terminates in an upwardly directed outlet end 26. The reactor riser used in this invention discharges into a device that performs an initial separation between the catalyst and gaseous components in the riser. The term "gaseous components" includes lift gas, product gases and vapors, and unconverted feed components. Riser end 26 is located in a separation device 28 which, in turn, is located in a reactor vessel 30. The separation device removes a majority of the catalyst from the cracked hydrocarbon vapors that exit riser end 26. Preferably, the end of the riser will terminate with one or more upwardly directed openings that discharge the catalyst and gaseous mixture in an upward direction into a dilute phase section of a disengaging vessel. The open end of the riser can be of an ordinary vented riser design as described in the prior art patents of this application or of any other configuration that provides a substantial separation of catalyst from gaseous material in the dilute phase section of the reactor vessel. The flow regime within the riser will influence the separation at the end of the riser.

It is not essential to this invention that any particular type of separation device receive the riser effluent. However, whatever type of riser separation device is used, it must achieve a high separation efficiency. Since the catalyst usually has a void volume which will retain up to 7 wt. % of the riser gaseous components, some of the riser gaseous components must be displaced from the catalyst void volume to achieve the preferred recovery of over 95 wt. % recovery of riser product components. A preferred manner of displacing riser gaseous components from the catalyst leaving the riser is to maintain a dense catalyst bed adjacent to the riser outlet that is separated from the larger dense bed in the reactor vessel. This dense bed location minimizes the dilute phase volume of the catalyst and riser products, thereby avoiding the aforementioned problems of prolonged catalyst contact time and overcracking. The dense bed arrangement itself reduces the concentration of riser products in the interstitial void volume to equilibrium levels by passing a displacement fluid therethrough. Maintaining a dense bed and passing a displacement fluid through the bed allows a complete displacement of the riser gaseous products. Without the dense bed, it is difficult to obtain the necessary displacement of gaseous products. Restricting the catalyst velocity through the dense bed also facilitates the displacement of riser gaseous components. The catalyst flux or catalyst velocity through the dense bed should be less than the bubble velocity through the bed. Accordingly, the catalyst velocity through the bed should not exceed 1 ft/sec. Protracted contact of the catalyst with the displacement fluid in the dense bed can also desorb additional gaseous riser products from the skeletal pore volume of the catalyst. However, the benefits of increased product recovery must be balanced against the disadvantage of additional residence time for the reactor products in the separation device.

The separation device has a location in an upper portion of reactor vessel 30. Catalyst removed by separation device 28 falls into dense catalyst bed 52. Reactor vessel 30 has an open volume above catalyst bed 52 that provides a dilute phase section 74. The lower portion of reactor vessel 30 is referred to as the reactor vessel reaction zone. Catalyst collecting in bed 52, although containing a relatively high coke concentration, still has sufficient activity for catalytic use. Typically, the coke concentration of the catalyst in this bed will range from 1.5 to 0.6 wt. %. Bed 52 supplies a high inventory of catalyst that is available for contact with a secondary feed. If used, secondary feed can enter the dense bed 52 at any point below the upper surface of the dense bed. Where a subadjacent stripping vessel receives catalyst from the reactor vessel, the secondary feed may be injected into the stripper at any location, including the bottom, provided the injection point is above the lowermost point of steam injection. Secondary Feeds to the reactor zone include hydrotreated heavy naphtha, hydrotreated light cycle oil, light reformate and light olefins. A preferred secondary feed is a benzene containing stream that is alkylated to produce $C_7$ and $C_8$ aromatics. More preferably the benzene containing stream is a light reformate stream. The Figure depicts the secondary feed entering reactor 30 through a line 55 with a distributor 57 disbursing the feed over the bottom of bed 52.

Catalyst cascades downward from bed 52 through a series of baffles 60 that project transversely across the cross-section of a stripping zone 62' in stripper vessel 62. Preferably, stripping zone 62' communicates directly with the bottom of reactor vessel 30 and more preferably has a sub-adjacent location relative thereto. As the catalyst falls, steam or another stripping medium from a distributor 64 rises countercurrently and contacts the catalyst to increase the stripping of adsorbed components from the surface of the catalyst. A conduit 66 conducts stripped catalyst into catalyst regenerator 10 which combustively removes coke from the surface of the catalyst to provide regenerated catalyst.

The countercurrently rising stripping medium of stripping zone 62' desorbs hydrocarbons and other sorbed components from the catalyst surface and pore volume. Stripped hydrocarbons and stripping medium rise through bed 52 and combine with any secondary feed and any resulting products in the dilute phase 74 of reactor vessel 30 to form a reactor vessel product stream. At the top of dilute phase 74, an outlet withdraws the stripping medium and stripped hydrocarbons from the reactor vessel. One method of withdrawing the stripping medium and hydrocarbons is shown in FIG. 1 as cyclone 75 which separates catalyst from the reactor vessel product stream. A line 77 withdraws the reactor vessel product stream from the cyclone and out of reactor vessel 30. The reactor vessel product stream passes out of the reactor vessel via line 77 to a reactor quench vessel 90.

The separation zone also provides a separate product stream. Cyclone 42 receives the cracked vapors from the separation device and removes essentially all of the remaining catalyst from the riser vapor stream or riser product stream. Separated catalyst from cyclone 42 drops downward into the reactor through dip legs 50 into a catalyst bed 52. Conduit 44 withdraws the riser vapors from the top of the cyclone 42.

After separation from the catalyst, the cracked vapors of the riser enter a primary separation zone comprising a main column 45. Main column 45 fractionates the feed into at least four streams. These streams will include at least, a gas stream 46 containing gasoline, a heavier fraction 51 comprising light cycle oil, a higher boiling fraction 52 comprising heavy cycle oil and a heavy hydrocarbon stream 49. As known to those skilled in the art, a gasoline fraction can be further subdivided by the main column or by other means into heavy and light gasoline cuts. When taken, the light gasoline fraction is typically withdrawn with an initial boiling point in the $C_5$ range and an end point in a range of 300°–400° F. and preferably at a temperature of about 380° F. The cut point for this fraction is preferably selected to retain olefins which would otherwise be lost by additional cracking to lighter components and saturation by the recycle of the heavy gasoline fraction. The heavy gasoline cut ordinarily comprises the next heavier fraction boiling above the light gasoline fraction. At the operating conditions of the main column, this cut point will be at about the boiling point of $C_9$ aromatics, in particular 1,2,4-trimethylbenzene. A lower cut point temperature between the light and heavy gasoline, down to about 320° F., but preferably above 360° F., will bring additional $C_9$ aromatics into the heavy gasoline recycle stream. In its most basic form, the upper end of the heavy gasoline cut is selected to retain $C_{12}$ aromatics. The $C_{12}$ to $C_9$ aromatics in the heavy gasoline fraction are readily dealkylated and can then be transferred to the reaction zone as a secondary feed. When operating with such a secondary feed, higher end points for the heavy gasoline cut will carry bicyclic compounds into the secondary reaction zone and bring little benefit to the process unless these bicyclic components are pretreated. These bicyclic compounds include indenes, biphenyls and naphthalenes which are refractory to cracking under the conditions in the reactor vessel reaction zone. Therefore, the heavy gasoline will usually have an end point of about 400°–430° F. and more preferably about 420° F. The entire gasoline fraction or light gasoline fraction enters a gas concentration section that uses a primary absorber and, in most cases, a secondary absorber to separate lighter components from the gasoline stream using fractions from the main column or the gas concentration section as adsorption streams. The light cycle oil fraction will comprise the next hydrocarbon fraction having a boiling point above the heavy gasoline stream and will usually have an end boiling point in a range of about 400°–550° F. and the heavy cycle oil will have a boiling point in a range of about 500°–680° F. A heavy cycle oil stream 52 is withdrawn and, after withdrawing a net portion in stream 53, the remainder is cooled and recycled to the main fractionator.

An essential part of this invention is the quenching and initial contacting of the reactor product stream in a reactor quench zone. The reactor quench zone normally comprises a separate vessel that receives all or part of the reactor product stream and contacts it with the heavy hydrocarbon, or bottoms from the primary fractionation zone. Contact of the reactor product stream with the relatively heavy quench fluid will take the reactor products from a temperature in a range of about 900° to 1150° F. to a temperature of 300° to 500° F. The heavy hydrocarbon also removes catalyst particles from the dry gas product stream while absorbing some C3 and heavier higher hydrocarbons that are returned to the primary fractionation zone with the heavy hydrocarbon stream.

The quenched overhead stream from the reactor quench zone could be sent directly to fuel gas, but contains valuable hydrocarbons which beneficially undergo additional separation steps to recover useful products. The additional recovery of useful products normally takes place in a reactor absorber vessel. The absorber vessel contacts all or a portion of the net gas from the reactor quench zone with a hydrocarbon stream, preferably cycle oil, to absorb C3 and higher hydrocarbons which are again returned to the primary fractionation zone. Between the reactor quench zone and the reactor absorber, the net overhead gas from the reactor quench zone may undergo additional stages of condensing and separation. Since the reactor quench zone also preferably operates at reactor pressure, additional stages of compression may be desirable to raise the reactor absorber pressure. The reactor absorber will typically operate at a pressure of from 50 to 75 psig. Additional liquids condensed from the quenched overhead stream upstream of the reactor absorber are recycled to an appropriate point in the primary fractionation zone or in the gas concentration section. In this arrangement the net gas from the reactor quench zone can also provide lift gas to the reactor vessel. It is also possible, particularly in new unit designs, to use the secondary absorber of the gas concentration section as the reactor absorber.

The use of a reactor absorber for separating net gas from the quenched gas overhead stream can provide additional products. Independent separation of the reactor product stream is particularly beneficial for those cases where a secondary feed has been processed in the reactor portion of the vessel. Particularly in those cases where a secondary product has been processed, the reactor gas stream can contain relatively high amounts of hydrogen. Therefore, the reactor gas stream can be separated to recover a hydrogen-rich stream. Preferred methods for hydrogen recovery include pressure swing or thermal swing adsorption processes, permeable membrane processes, or cyrogenic processes.

The embodiment depicted by the figure shows the gasoline stream 46 going overhead through a cooler 48 and into a separator 54. Line 56 withdraws gasoline boiling range liquid from the bottom of separator 54 and refluxes a portion back to fractionator 45 via line 58 and pump 68. Wet gas compressor 70 takes overhead gas from receiver 54 via line 72 and discharges the compressed gas through a line 74 to the gas concentration section. Pump 78 transfers liquid from receiver 54 to the gas concentration section. A portion of the heavy hydrocarbon stream from line 49 passes, via line 80 and pump 82 through a cooler 84 and returns to the main fractionator via line 86. The remaining portion of the heavy hydrocarbon stream is withdrawn by line 88 for other processing such as recycle to the FCC unit.

In addition to the reactor product stream carried by line 77, line 92 carries another portion of the main fractionator bottoms from line 49 to the top of vessel 90. Before entering vessel 90, the contents of line 92 are cooled. The mass ratio of heavy hydrocarbon to reactor product entering column 90 will typically be in a ratio of from 5.0 to 1.0. Vessel 90 provides a trayed or packed column to provide multiple stages of contacting between the hot vapor and the main column bottom stream that provides quenching. A portion of the bottoms stream, taken by line 98 and cooled in cooler 102 may be refluxed back to the quench vessel via line 100. Quench vessel 90 will typically provide 5 tray levels below the heavy hydrocarbon addition point and another 5 tray levels below the addition point of any cooled bottoms stream. Net bottoms from the quench vessel containing mainly absorbed $C_3$ and higher hydrocarbons are returned to the main fractionator by lines 104 and 108 after heat exchange against the incoming bottom stream in exchanger 106. Line 110 carries a quenched overhead stream of vapors through a condenser 112 and into a receiver 114. Liquid hydrocarbons from receiver 114, comprising mainly $C_3$ and heavier wet gas components, are pumped by a Pump 116 and a line 118 into admixture with a quench vessel bottoms for return to the main fractionator. Net overhead vapors from receiver 114 pass overhead via line 120 into single stage compressor 122 where the pressure of the vapors are increased to about 50 to 75 psig. Line 124 carries compressed vapors through condenser 126 into a receiver 128. Net gas from receiver 128 passes via lines 130 and 131 into a reactor absorber vessel 132.

A portion of the net gas from line 130 is withdrawn and after any further processing (not shown) enters line 16 to supply lift gas to lift gas zone 18 of the reactor riser. To supply lift gas the cooled gas that enters compressor 124 must be compressed to riser inlet conditions. These conditions require a pressure approximately 10 psi higher than the reactor pressure. This typically requires compression of the gas to about 15 to 50 psi. Since the gas concentration section of the FCC separation section usually compresses gas to about 200 psi, there is a significant energy savings in processing the lift gas stream to a lower pressure independent of the gas concentration section. In addition, processing the lift gas independent of the gas concentration section provides a capacity benefit by reducing the volume of lift gas that passes through the gas concentration section.

A line 134 diverts a portion of the light cycle oil from line 51, which is passed via line 138 through exchanger 146 and a cooler 140 into reactor absorber 132. Reactor absorber 132 contacts the cooled light cycle oil with the remaining net overhead vapor through multiple packed or trayed stages of contacting. A typical reactor vapor absorber will contain 5 packed stages. The absorber removes mainly $C_3$ and higher hydrocarbons from the net gas stream and produces an overhead gas stream 142.

The mass flow of net gas entering reactor absorber 132 to light cycle oil from line 138 is typically in a ratio of from 0.01 to 0.10. Overhead gases from line 142 comprise mainly $C_2$ and lighter gases. The net gas from absorber 132 may pass directly to a fuel gas system. Often the net gas will contain significant quantities of hydrogen. Therefore, additional hydrogen processing of this gas stream is anticipated in the operation of this invention. A Pump 144 pushes a C3 and higher hydrocarbon-rich light cycle oil through heat exchanger 146 and back to the main column fractionator via line 148. Line 148 is combined with the refluxed light cycle oil from line 51, which passes through cooler 59 before reentering the main fractionator via line 149.

Additional product recovery takes place in a traditional FCC gas concentration section. Compressed overhead vapor from the gasoline stream taken via line 74 combines with a stripper overhead from a line 150 and a primary absorber bottoms 152. After further cooling in condenser 154, a pump 158 passes net liquid via a line 160 from receiver 128 into admixture with the contents of line 156. The combined streams enter a high pressure receiver 162. Gas from the high pressure receiver passes into a primary absorber 164 via line 166. The primary absorber contacts the gas with a gasoline product stream 168 and a gasoline boiling range material from line 76 to absorb C3 and higher hydrocarbons and separate C2 and lower boiling fractions from the gas to the primary absorber. The off gas from the primary absorber passes via a line 170 to a secondary or sponge absorber 172. The secondary absorber contacts the off gas with light cycle oil from a line 174 after cooling of the light cycle oil in exchanger 177 and cooler 175. Light cycle oil from line 174 absorbs most of the remaining $C_4$ and higher hydrocarbons and returns to the main fractionator via lines 176 and 149. A line 178 withdraws off gas from the secondary or sponge absorber for use as fuel gas. Line 180 passes liquid from high pressure separator 162 through a pump 182 and into a stripper 186 which removes most of the $C_2$ and lighter gases and supplies a liquid stream 188 to a debutanizer 190. $C_3$ and $C_4$ hydrocarbons from debutanizer 190 are taken overhead by line 192 for further treatment. A line 194 withdraws debutanized gasoline for recycle to the primary absorber and to supply a net debutanized gasoline product stream 196. The rejection of dry gas components in the reactor absorber 132 reduces the relative amount of debutanized gasoline product recycled to the primary absorber.

EXAMPLE

The following example shows how the use of an FCC reactor of the type shown in the Figure and that the recovery of separate riser and reactor product streams can increase the total product processing capacity of the product recovery section. In a first case, the example shows the operation of a product recovery zone for a typical FCC process that recovers a single product stream from the riser and reaction zone of an FCC unit. A second case demonstrates the increase in feed process capacity and product recoveries made possible by the reaction zone and product recover) arrangement of this invention. This example is based on engineering calculations and operating data obtained from similar components and operating FCC units.

| CASE 1 | | | |
|---|---|---|---|
| CAPACITY, BPSD | 10,693 | | |
| WET GAS COMPRESSOR | | | |
| 1st STAGE, MMSCFD | 11.36 | 2nd STAGE, MMSCFD | 10.14 |
| ACFM | 5237 | ACFM | 5237 |
| MW | 37.7 | MW | 37.7 |
| BHP | 813 | BHP | 813 |
| REACTOR VAPOR MMSCFD | — | | |
| NET GAS ACFM | — | | |
| COMPRESSOR MW | — | | |
| BHP | — | | |
| ABSORBERS | | | |
| PRIMARY: L/V | | | 1.15 |
| INTERCOOLERS, MMBTU/HR | | | 1.11 |
| THEOR STGS. | | | 13 |
| I.D. | | | 3-0 |
| SECONDARY: L/V | | | 0.35 |
| THEOR STGS. | | | 5 |
| I.D. | | | 2-0 |
| DEBUTANIZER BOTTOMS RECYCLE, | | | |
| MPH | | | 250 |
| RECYCLE/NET (MOLAR) | | | 0.43 |
| COLUMNS: | | | |
| STRIPPER: STGS | | | 20 |
| I.D. | | | 5-0 |
| Q REBOILER, MMBTU/HR | | | 9.92 |
| DEBUTANIZERS, STG | | | 4-0 |
| I.D. | | | 5-0 |
| R/F | | | 0.80 |
| Q REBOILER, MMBTU/HR | | | 9.51 |
| REACTOR VAPOR QUENCH COLUMN | | | |
| I.D. | | | — |
| TRAYS | | | — |
| REACTOR VAPOR ABSORBER | | | |
| I.D. | | | — |
| TRAYS | | | — |
| PRODUCTS | | | |
| NET GAS, MMSCFD | | | 3.55 |
| NET HEATING VALUE, MMBTU/HR | | | 115.40 |
| $C_3$-$C_4$ | | | 2233 |
| $C_5$+ GASOLINE, BPSD | | | 5246 |
| RECOVERY, WT-% | | | 100 |

An FCC unit is operated to process 10,369 barrels/-stream day of a vacuum gas oil feed. The feed is contacted with a catalyst and lift gas mixture in the bottom of a reactor riser and enters a reactor vessel that operates at a pressure of about 30 psig. The composition of the lift gas based on the feed is approximately 1.5 wt. % steam and 1.5 wt. % light hydrocarbon. Product hydrocarbons are disengaged from the catalyst in the disengaging chamber and a riser cyclone. The catalyst travels downwardly through a first stage of a stripping section that operates at approximately the same temperature as the upper end of the reactor riser. Catalyst passing through the stripper is contacted with gas that enters the bottom of the stripper. The stripping gas first contacts the spent catalyst in the lower section of the stripper. The stripping gas removes absorbed hydrocarbons from the surface of the catalyst and the stripping gas becomes mixed with light paraffins and hydrogen. A quantity of stripping gas mixture equal to approximately 2 wt. % of the reactor feed is separated from the gases and vapors passing upwardly from the lower section of the stripper and are collected in an upper section of a reactor vessel. The gaseous mixture in the upper portion of the reactor vessel passes into the same cyclone separators that receive the riser products.

All of the products from the reaction zone were transferred directly to a primary fractionation zone which cooled the product vapors and provided a net overhead gasoline stream. Beginning with separation in the main column overhead receiver, the gasoline fraction passed on to a gas concentration section. A wet gas compressor operating under the condition shown in Case 1 of Table 1 passes the net gas on to a high pressure separator which feeds a primary absorber operating under the conditions shown in Table 1. The overhead from the primary absorber passes to a secondary absorber described in Table 1. Stripped liquid from the high pressure separator provides the $C_3$ and $C_4$ products shown in Table 1 along with a net gasoline product. The ratio of recycled to net debutanized gasoline product is presented in Table 1. Case 1 demonstrates a substantial amount of the debutanized gasoline is recycled back to the primary absorber to recover the $C_3$ through $C_4$ products shown in Table 1.

| CASE 2 | | | |
|---|---|---|---|
| CAPACITY, BPSD | 13,900 | | |
| WET GAS COMPRESSOR | | | |
| 1st STAGE, MMSCFD | 11.33 | 2nd STAGE, MMSCFD | 9.90 |
| ACFM | 5195 | ACFM | 1551 |
| MW | 42.9 | MW | 40.1 |
| BHP | 892 | BHP | 778 |
| REACTOR VAPOR MMSCFD | 2.59 | | |
| NET GAS ACFM | 952 | | |
| COMPRESSOR MW | 24.2 | | |
| BHP | 271 | | |
| ABSORBERS | | | |
| PRIMARY: L/V | | | 1.22 |
| INTERCOOLERS, MMBTU/HR | | | 1.41 |
| THEOR STGS. | | | 13 |
| I.D. | | | 3-0 |
| SECONDARY: L/V | | | 0.61 |
| THEOR STGS. | | | 5 |
| I.D. | | | 2-6 (new) |
| DEBUTANIZER BOTTOMS RECYCLE, | | | |
| MPH | | | 25 |
| RECYCLE/NET (MOLAR) | | | 0.03 |
| COLUMNS: | | | |
| STRIPPER: STGS | | | 20 |
| I.D. | | | 5-0 |
| Q REBOILER, MMBTU/HR | | | 9.63 |
| DEBUTANIZERS, STG | | | 4-0 |
| I.D. | | | 5-0 |
| R/F | | | 0.73 |
| Q REBOILER, MMBTU/HR | | | 10.58 |
| REACTOR VAPOR QUENCH COLUMN | | | |
| I.D. | | | 3-6 |
| TRAYS | | | 5, +5 side to side trays |
| REACTOR VAPOR ABSORBER | | | |
| I.D. | | | 2-0 |
| TRAYS | | | 5 stages (packed) |
| PRODUCTS | | | |
| NET GAS, MMSCFD | | | 4.65 |
| NET HEATING VALUE, MMBTU/HR | | | 153.72 |
| $C_3$-$C^4$ | | | 2874 |
| $C_5$+ GASOLINE, BPSD | | | 6823 |
| RECOVERY, WT-% | | | 100 |

By incorporating a separate recovery of reactor and riser product streams and quenching and absorbing the reactor product gases in a separate quench and absorber vessel the FCC gas concentration section of example 1 processes 13,900 barrels/stream day of a vacuum gas oil feed. The feed is contacted with a catalyst and lift gas mixture in the bottom of a reactor riser and enters a reactor vessel that operates in the same manner as that described in Example 1. Product hydrocarbons are again disengaged from the catalyst in the disengaging chamber and a riser cyclone. The catalyst travels downwardly through a first stage of a stripping section that operates in the same manner as Case 1. The gaseous mixture in the upper portion of the reactor vessel passes through a cyclone separator that reduces the loading of catalyst particles in the gaseous mixture and provides a separate reactor product stream.

The riser products stream recovered from the disengaging zone and cyclone separators passes on to a main column as previously described. The reactor product stream is first quenched with the bottoms from the primary fractionation zone. The quenched liquid and absorbed hydrocarbon return to the main column while net overhead gas from the quenched column passes through a reactor vapor net compressor which operates at the conditions shown in Table 1 and passes the net overhead gas from the quenched vessel to a reactor vapor absorber. Table 1 describes both the reactor vapor quench column and the reactor vapor absorber. A comparison of the product from Case 1 and Case 2 shows that both Cases recovered a proportionally equivalent amount of products. However, Case 2 recovered approximately 30% more products while using only about 20% more total compressor horsepower. In addition, the net fuel gas stream recovered from the operation of Case 2 has a substantially higher heating value than that recovered in Case 1.

We claim:

1. A process for the fluidized catalytic cracking (FCC) of an FCC feedstock and the recovery of a riser effluent stream and a reactor effluent stream, said process comprising:

a) passing an FCC feedstock and regenerated catalyst particles to a reactor riser and transporting said catalyst and feedstock through said riser to convert said feedstock;

b) discharging a mixture comprising catalyst particles and gaseous hydrocarbons from a discharge end of said riser directly into a separation zone, separating gaseous hydrocarbons from catalyst containing adsorbed hydrocarbons and recovering a riser effluent stream from said separation zone;

c) passing said catalyst containing adsorbed hydrocarbons from said separation zone into a reaction vessel and withdrawing a reactor effluent stream from said reactor vessel;

d) separating said riser effluent stream in a primary fractionation zone and recovering fractions comprising a heavy hydrocarbon stream, a light cycle oil stream and a gasoline stream;

e) passing said reactor effluent stream to a reactor quench zone and contacting said reactor effluent stream with at least a portion of at least one of said fractions in said quench zone to absorb $C_3$ and higher hydrocarbons from said reactor effluent stream and produce a quenched overhead stream and a primary recycle stream;

f) returning at least a portion of said primary recycle stream to said primary fractionation zone;

g) passing at least a portion of said quenched overhead stream to a reactor absorber and contacting said at least a portion of said quenched overhead stream with at least a portion of said light cycle oil stream in said reactor absorber to absorb $C_3$ and higher hydrocarbons from said quenched overhead stream and produce a reactor gas stream comprising $C_2$ hydrocarbons and lower boiling gases and a $C_3$ rich light cycle oil stream; and, h) returning said $C_3$ rich light cycle oil stream to said primary fractionation zone.

2. The process of claim 1 wherein at least one of said fractions of step e) comprises a heavy hydrocarbon stream having a boiling point greater than said light cycle oil stream.

3. The process of claim 1 wherein a gas fraction of said gasoline stream is contacted with an absorber liquid in a primary absorber and at least a fraction of said quenched overhead vapor is compressed, condensed and passed to said primary absorber.

4. The process of claim 3 wherein a condensed fraction of said gasoline fraction is stripped and debutanized to provide a debutanized gasoline product and a portion of said absorber liquid comprises a portion of said debutanized gasoline product.

5. The process of claim 1 wherein said reactor gas stream is separated to reject hydrocarbons and recover a hydrogen-rich stream.

6. The process of claim 1 wherein a secondary feed stream is passed to said reactor zone and recovered from said reactor with said reactor effluent stream.

7. The process of claim 6 wherein said secondary feed stream comprises at least one of hydrotreated heavy naphtha, hydrotreated light cycle oil, light reformate, and olefins.

8. The process of claim 1 wherein a lift gas contacts said regenerated catalyst particles in a section of said riser upstream of the contacting of said regenerated catalyst particles and said feedstock and said lift gas comprises a compressed gas fraction of said quenched overhead stream.

9. The process of claim 1 wherein said quenched overhead stream is condensed and separated into a first absorber gas that supplies an input to said reactor absorber and a first recycle liquid that is returned to said primary fractionation zone.

10. The process of claim 8 wherein said quenched overhead stream is condensed and separated into a first absorber gas and a first recycle liquid that is returned to said primary fractionation zone, said first absorber gas is compressed condensed and separated into a second absorber gas and a second recycle liquid, said second recycle liquid is combined with said gasoline stream, a first portion of said second absorber gas comprises said lift gas and a second portion of said second absorber gas is passed to said reactor absorber.

11. The process of claim 1 wherein said reactor product stream comprises less than 10 wt. % of the gaseous products entering said separation zone.

12. A process for the fluidized catalytic cracking (FCC) of an FCC feedstock and the recovery of a riser product stream and a reactor product stream, said process comprising:

a) passing said FCC feedstock and regenerated catalyst particles to a reactor riser and transporting said catalyst and feedstock upwardly through said riser thereby converting said feedstock to a riser gaseous product stream;

b) discharging a mixture of catalyst particles and gaseous products from a discharge end of said riser directly into a disengaging vessel, separating gaseous components from catalyst containing adsorbed hydrocarbons in said disengaging vessel and recovering a riser product stream from said disengaging vessel;

c) passing said catalyst containing adsorbed hydrocarbons from said disengaging vessel into a reaction vessel, maintaining a dense bed of catalyst in said reaction vessel and withdrawing a reactor product stream from said reactor vessel;

d) passing spent catalyst from said reactor vessel into a regeneration zone and contacting said spent catalyst with a regeneration gas in said regeneration zone to combust coke from said catalyst particles and produce regenerated catalyst particles for transfer to said reactor riser;

e) separating said riser product stream in a primary fractionation zone and producing a heavy hydrocarbon stream, a light cycle oil stream and a gasoline stream;

f) condensing said gasoline stream and separating said gasoline stream into a first vapor gasoline fraction and a first liquid gasoline fraction;

g) passing said reactor product stream to a reactor quench zone and contacting said reactor product stream with a portion of said heavy hydrocarbon stream in said quench zone to absorb $C_3$ and higher hydrocarbons from said reactor product stream and produce a quenched overhead stream and a heavy hydrocarbon recycle stream and returning said heavy hydrocarbon recycle stream to said primary fractionation zone;

h) separating said quenched overhead fraction into a first absorber gas stream and a first recycle liquid and passing at least a portion of said first recycle liquid to said primary fractionation zone;

i) separating said first absorber gas into a second absorber gas stream and a second recycle liquid;

j) passing said second absorber gas stream to a reactor absorber and contacting said second absorber gas with a portion of said light cycle oil stream in said reactor absorber to absorb $C_3$ and higher hydrocarbons from said second absorber gas and produce a reactor gas stream comprising $C_2$ hydrocarbons and lower boiling gases and a $C_3$ rich light cycle oil stream and returning said $C_3$ rich light cycle oil stream to said primary fractionation zone;

k) combining said second recycle liquid with said first vapor gasoline fraction and separating the combined stream into a second vapor gasoline fraction and second gasoline liquid fraction;

l) stripping and debutanizing said second gasoline fraction to produce a gasoline product stream; and, m) contacting said second gasoline vapor stream with a portion of at least one of said gasoline product stream and said first liquid gasoline fraction to absorb $C_2$ and lower boiling hydrocarbons and produce a light gas stream and a gasoline recycle stream.

13. The process of claim 12 wherein said light gas stream contacts a portion of said light cycle oil in a secondary absorber to absorb $C_4$ and higher boiling hydrocarbons and the light cycle oil from said secondary absorber is recycled to said primary fractionation zone.

14. The process of claim 12 wherein a stripping zone is located subadjacent to said reactor vessel, said catalyst is passed from said reactor vessel to said stripping zone, a stripping fluid is passed upwardly through said stripping zone and said spent catalyst is transferred from said stripping zone to said regeneration vessel.

15. The process of claim 14 wherein a secondary feed is injected into said stripping zone.

16. The process of claim 12 wherein said disengaging vessel is located in said reactor vessel.

17. The process of claim 16 wherein a dense bed of said partially spent catalyst is maintained in said disengaging vessel and a stripping medium passes upwardly through said dense bed of catalyst in said disengaging vessel and is withdrawn with said riser product stream.

18. The process of claim 12 wherein said light cycle oil stream has an end boiling point in a range of 500°-650° F. and a portion of said light cycle oil is contacted with catalyst in said dense bed of said reaction vessel.

19. The process of claim 12 wherein a benzene containing stream is passed to said dense bed of said reaction vessel and alkylated to produce $C_7$ and $C_8$ aromatics.

20. The process of claim 19 wherein said benzene containing stream is a light reformate stream.

21. A process for the fluidized catalytic cracking (FCC) of an FCC feedstock and the recovery of a riser product stream and a reactor product stream, said process comprising:

a) passing said FCC feedstock and regenerated catalyst particles to a reactor riser and transporting said catalyst and feedstock upwardly through said riser thereby converting said feedstock to a riser gaseous product stream;

b) discharging a mixture of catalyst particles and gaseous products from a discharge end of said riser directly into a separation zone, separating gaseous components from catalyst containing adsorbed hydrocarbons in said disengaging vessel and recovering a riser product stream from said separation zone;

c) passing said catalyst containing adsorbed hydrocarbons from said separation zone into a reaction vessel, maintaining a dense bed of catalyst in said reaction vessel and withdrawing a reactor product stream from said reactor vessel;

d) separating said riser product stream in a primary fractionation zone and producing a heavy hydrocarbon stream, a light cycle oil stream and a gasoline stream;

e) condensing said gasoline stream and separating said gasoline stream into a first vapor gasoline fraction and a first liquid gasoline fraction;

f) passing said reactor product stream to a reactor quench zone and contacting said reactor product stream with a portion of said heavy hydrocarbon stream in said quench zone to absorb $C_3$ and higher hydrocarbons from said reactor product stream and produce a quenched overhead stream and a heavy hydrocarbon recycle stream and returning said heavy hydrocarbon recycle stream to said primary fractionation zone;

g) condensing said quenched overhead stream and separating said quenched overhead stream into a first absorber gas stream and a first recycle liquid and passing at least a portion of said first recycle liquid to said to said primary fractionation zone;

h) condensing said first absorber gas stream and separating said first absorber gas stream into a second absorber gas stream and a second recycle liquid;

i) combining said second recycle liquid with said first vapor gasoline fraction and separating the combined stream into a second vapor gasoline fraction and second gasoline liquid fraction;

j) stripping and debutanizing said second gasoline fraction to produce a gasoline product stream;

k) contacting said second gasoline vapor stream with a portion of said gasoline product stream and a portion of said first liquid gasoline fraction to absorb $C_2$ and lower boiling hydrocarbons and produce a light gas stream and a gasoline recycle stream and recycling said gasoline recycle stream to said first gasoline vapor stream; and, l) contacting said light gas stream and said second absorber gas stream with a portion of said light cycle oil in a secondary absorber to absorb $C_4$ and higher boiling hydrocarbons, recycling the light cycle oil from said secondary absorber to said primary fractionation zone and recovering a net gas stream from said secondary absorber.

* * * * *